US011974645B2

(12) United States Patent
Sung et al.

(10) Patent No.: US 11,974,645 B2
(45) Date of Patent: May 7, 2024

(54) DEVICE AND METHOD FOR COILING HAIR

(71) Applicant: Kiss Nail Products, Inc., Port Washington, NY (US)

(72) Inventors: Siyong Sung, Roslyn Heights, NY (US); Kyusang Han, Port Washington, NY (US); Younghun Kim, Plainview, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 103 days.

(21) Appl. No.: 17/178,725

(22) Filed: Feb. 18, 2021

(65) Prior Publication Data

US 2022/0256989 A1 Aug. 18, 2022

(51) Int. Cl.

| | |
|---|---|
| ***A45D 2/12*** | (2006.01) |
| ***A45D 2/14*** | (2006.01) |
| ***A45D 24/02*** | (2006.01) |

(52) U.S. Cl.

CPC ..... *A45D 2/14* (2013.01); *A45D 2/122* (2013.01)

(58) Field of Classification Search

CPC . A45D 2/14; A45D 2/122; A45D 2/16; A45D 24/02; A45D 24/04; A45D 24/14; A45D 24/32; A45D 2024/345; A46D 1/0269; A46D 1/0261; A46D 1/02; A46B 1/00; A46B 3/22; A46B 2200/102; A01K 13/00; A01K 13/002

See application file for complete search history.

(56) References Cited

U.S. PATENT DOCUMENTS

| | | | | |
|---|---|---|---|---|
| 7,198,050 | B2 | 4/2007 | Gopou | |
| D766,590 | S | 9/2016 | Lee | |
| 9,877,562 | B2 | 1/2018 | Guy-Rabi et al. | |
| 10,856,635 | B2 * | 12/2020 | Chee-Ping | A45D 2/00 |
| 2014/0060563 | A1 | 3/2014 | Haynes | |
| 2015/0189979 | A1 | 7/2015 | Stanton | |
| 2020/0154873 | A1 * | 5/2020 | Chang | A46B 9/026 |

FOREIGN PATENT DOCUMENTS

| | | | |
|---|---|---|---|
| CN | 109393707 | A | 3/2019 |
| DE | 202016100143 | * | 4/2016 |
| JP | 2000060640 | A | 2/2000 |
| JP | 201780191 | * | 5/2017 |
| KR | 102148132 | B1 | 8/2020 |

OTHER PUBLICATIONS

JP 2017-80191 Computer Translation (Year: 2017).*
DE 202016100143 Computer Translation (Year: 2016).*
International Search Report and Written Opinion received for International Application No. PCT/US2022/017061 dated Jun. 7, 2022, 10 Pages.

* cited by examiner

*Primary Examiner* — Rachel R Steitz
(74) *Attorney, Agent, or Firm* — Cherskov Flaynik & Gurda, LLC

(57) ABSTRACT

The invention provides an apparatus for coiling hair having a working end with a plurality of spaced-apart, round monoliths. The invention also provides a method for coiling hair having the steps of bringing an apparatus for coiling hair into contact with hair to be coiled wherein the apparatus for coiling hair has a working end with a plurality of spaced-apart, round monoliths; and moving the apparatus over and through the hair in a circular motion.

14 Claims, 11 Drawing Sheets

DEVICE AND METHOD FOR COILING HAIR

BACKGROUND OF THE INVENTION

1. Field of the Invention

The invention field is an apparatus and method for shaping hair, and more particularly but not exclusively, an apparatus and method for coiling hair.

2. Background of the Invention

Throughout modern history, the hairstyle has been an essential feature of a person's appearance. Depending on many factors, a person chooses their desired hairstyle and implements it through a combination of haircuts, self-styling devices, hair care/styling products, professional services, etc. Many tools and products exist to assist in the cutting and styling of a person's hair.

Most hair styling implements are hand implements designed to assist a user in shaping and styling hair through careful application to a user's hair to manipulate and style small sections of hair at a time. For example, combs untangle and smooth individual sections of hair. Similarly, curling irons and straightening irons operate only on one section of inserted hair at a time, where a user has to smooth or curl one section of hair then manually clamp the curling/straightening iron onto the next section of hair to be styled.

A need in the art exists for an apparatus and method for quickly and automatically coiling hair.

SUMMARY OF INVENTION

An object of the invention is to provide an apparatus and method for coiling hair that overcomes many of the prior art's drawbacks. The invention's feature is that the apparatus features a working end comprising a plurality of monoliths, for example round monoliths in one embodiment. An advantage of the invention is that the monoliths penetrate the hair of a person down to the scalp to facilitate contact with as much hair as possible to the coiling hair apparatus.

A further object of the invention is to provide a robust apparatus for coiling hair. A feature of the invention is the use of semi-rigid and minimally absorbent material. An advantage of the invention is that the device is durable and cleanable with water.

An additional object of the invention is to provide a coiling device that distributes a hair care product evenly and effectively. A feature of the invention is that the hair device comprises a hard material. Advantages stemming from a hard composition include a smaller size as the hard monoliths penetrate the user's hair and reach the end user's scalp to assist in the distribution of the hair care product.

A further object of the invention is to provide a coiling device that is easy to clean. A feature of the invention is that its material composition is non-absorbent, unlike devices that use a sponge or sponge-like material. An advantage of the device is that the coiling device can simply be rinsed out after use as it is made from non-absorbent material, and the device can be thoroughly sanitized using an appropriate solution or light exposure.

An added object of the invention is to provide a durable hair coiling device. A feature of the invention is that the monoliths are sufficiently rigid to not wear down with use. An advantage of the device is that it can be reused many times.

The invention provides an apparatus for coiling hair comprising a working end comprising a plurality of spaced-apart, monoliths.

The invention also provides a method for coiling hair comprising bringing an apparatus for coiling hair into contact with hair to be coiled wherein the apparatus for coiling hair comprises a working end comprising a plurality of spaced-apart, monoliths; and moving the apparatus over and through the hair in a circular motion.

BRIEF DESCRIPTION OF THE DRAWINGS

The invention, together with the above and other objects and advantages, will be best understood from the following detailed description of the preferred embodiment of the invention shown in the accompanying drawings, wherein.

DETAILED DESCRIPTION OF THE INVENTION

In various embodiments, the invention provides an apparatus and method for coiling hair. The apparatus for coiling hair comprises a working end comprising alternating protrusions, dimples, and apertures. The method of using said apparatus comprises bringing the working end of the apparatus in contact with the hair to be coiled and moving the apparatus in circular motions over and through the hair to be coiled.

The summary and the following detailed description of the present invention's specific embodiments will be better understood when read in conjunction with the appended drawings.

As used herein, an element or step recited in the singular and proceeded with the word "a" or "an" should be understood as not excluding plural said elements or steps unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
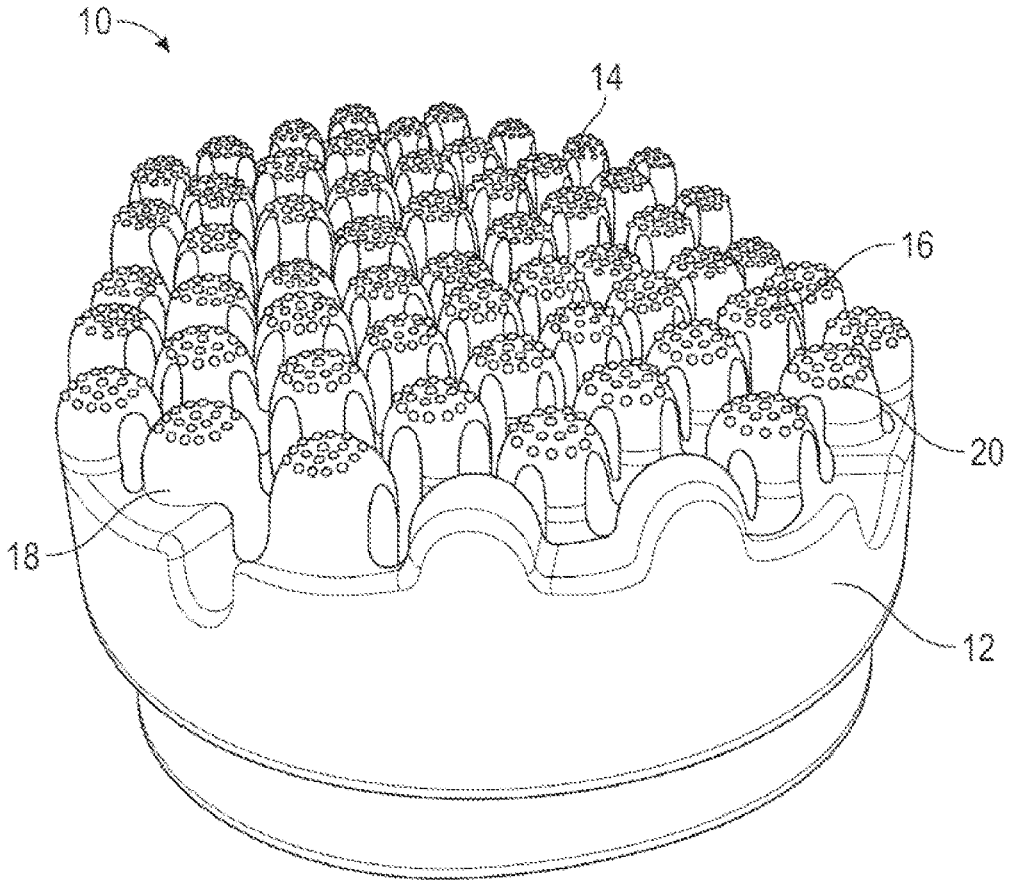
FIG. 1 depicts a perspective view of an apparatus for coiling hair in accordance with the features of the invention.

Turning to the figures, FIG. 1 is a perspective view of the invented hair coiling device 10. The device generally comprises a handheld implement 12 featuring a working end 14 comprising spaced apart, monoliths 16 having semi-spherical distal ends 18. The monoliths are made from a non-pliable material, in one embodiment. In one embodiment, the distal ends 18 are have a rounded profile. In at least some embodiments, the round distal ends 18 each include a plurality of small round protrusions extending from each of the distal ends The monoliths 16 are shown as having a substantially cylindrical shape or a cylindrical main body. However, monoliths 16 of having other shapes are possible, such as monoliths with a rectangular or polygonal cross-section. Such monoliths still have a rounded tip at the distal ends 18. Small gripping projections 20 extend from the distal ends 18 of the monoliths 16.

A salient feature of the device is the presence of the monoliths on the working end. The monoliths with the rounded distal ends allow for greater penetration of hair to be coiled than prior art devices. The structures and other features result in faster and tighter coiling using the instant device compared to prior art devices.

Figure 2:
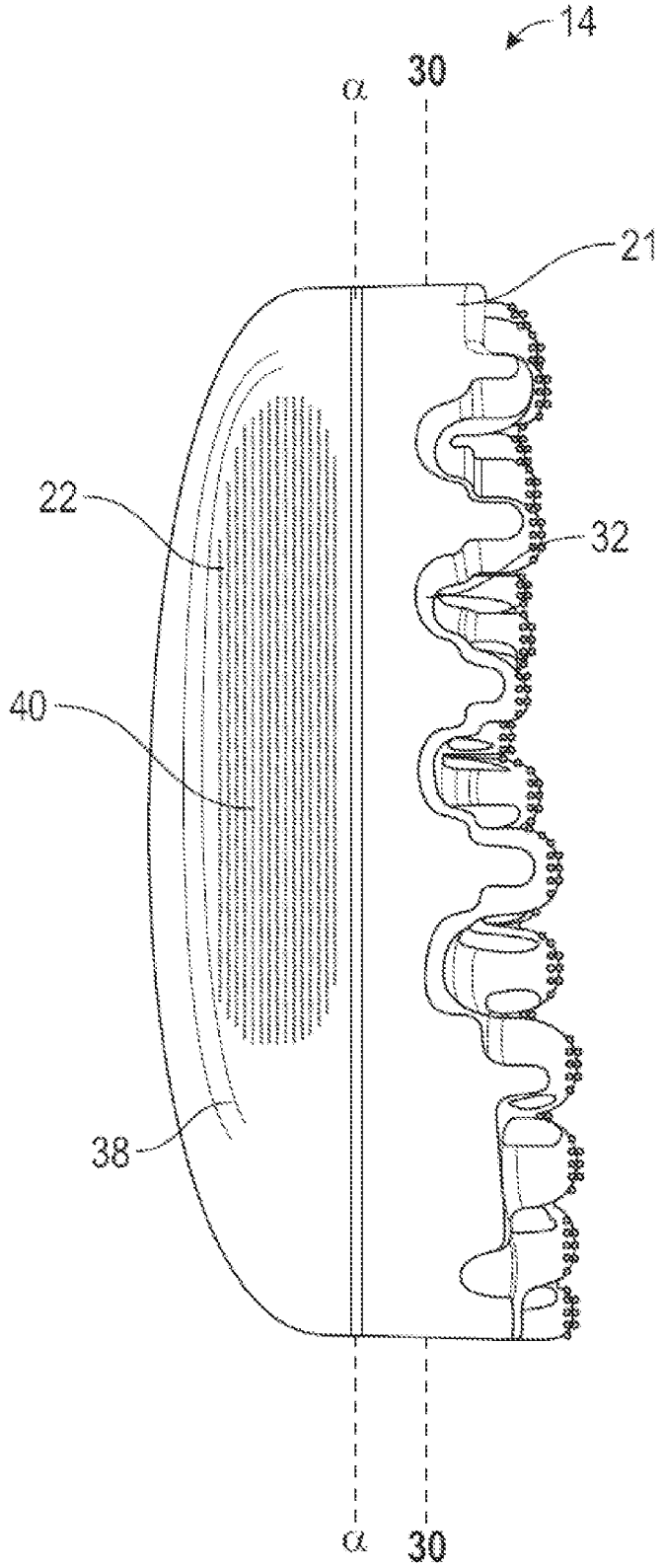
FIG. 2 depicts a side view of an apparatus for coiling hair in accordance with the features of the present invention.

FIG. 2 is a side view of the invented hair coiling device. As shown in FIG. 2, the working end 14 of the device extends from a handle portion 22 of the device. While only one side of the device 10 is shown in FIG. 2, a mirror-image second side includes an analogous handle portion 22. The two handle portions 22 with a flat body portion in the middle, form a flat handle area. In an embodiment, the working end 14 is formed from one piece of a semi-rigid material 21 secured permanently or reversibly to the handle portion 22 of the device that comprises the same or different material than the working end 14 of the device. In another embodiment, the entire device 10 is one-piece and formed from a single piece of material.

The working end of the invented hair coiling device comprises a rigid or semi-rigid material. Suitable materials include materials that are sufficiently rigid and non-absorbent enough to prevent absorption of hair care products and water. Exemplary materials include polyurethane, EVA (ethylene-vinyl acetate), silicon, rubber, wood, and combinations thereof. The inventors have discovered that rigid or semi-rigid but non-absorbent materials used in the instant invention imbue the invented device with superior properties to prior art devices such as ease of cleaning and increased durability. In one embodiment, the monoliths comprise a non-pliable material such as a hard plastic. In one embodiment, the monoliths comprise a polymer such as polyurethane, ethylene-vinyl acetate, silicone, rubber, and combinations thereof. In some embodiments, the monoliths and the main body of the hair coiling device comprise the same non-pliable or firm material. In other embodiments, at least some of the monoliths further include a tip comprising a different material. In one such embodiment, the tip includes a softer silicone that provides for a massaging action to assist in the application of the hair care product into the user's hair and not the device.

The use of a non-absorbent material in the device and monoliths allows the device to be made as small as possible and into a shape adapted to be held in one hand. The non-pliable materials penetrate the end user's hair and can reach the end-users' scalp. The use of a non-absorbent material also facilitates cleaning the device after use, including sanitization of the device. The device can be rinsed under running water, sprayed and wiped with a disinfectant, or sanitized by exposure to ultraviolet light. The method of sanitization varies depending on the composition of the device, but the non-pliable nature of the monoliths and other parts of the device make it particularly suitable for deep cleaning.

As shown in FIG. 2, the invention comprises a longitudinal axis a. A plane 30 parallel to the longitudinal axis a and containing all the centers 32 of the dimples defines a floor of the working end of the hair coiling device. The dimples are formed in the working end of the device such that the center of each dimple is substantially coplanar with the floor 30 of the working surface of the device. The apertures extend below the floor of the working end of the device. In an embodiment, the apertures have a depth of approximately 5 mm to 6 mm below the floor of the device's working end.

In an embodiment, the apertures appear as smoothbores in the working end of the invented hair coiling device. In another embodiment, walls of the apertures feature topography designed to increase frictional engagement with received hair strands such as rifling, medially extending protrusions, and combinations thereof.

FIG. 2 depicts that the working end of the invented hair coiling device is slightly curved. The curvature of the working end approximates the curvature of the human head to maximize the area of a user's head affected by the invented device in use. Said curvature is exemplary and not meant to be limiting and can be increased or decreased depending on the desires of the manufacturer. In at least some embodiments, the working end is flat without any curvature.

Figure 3:
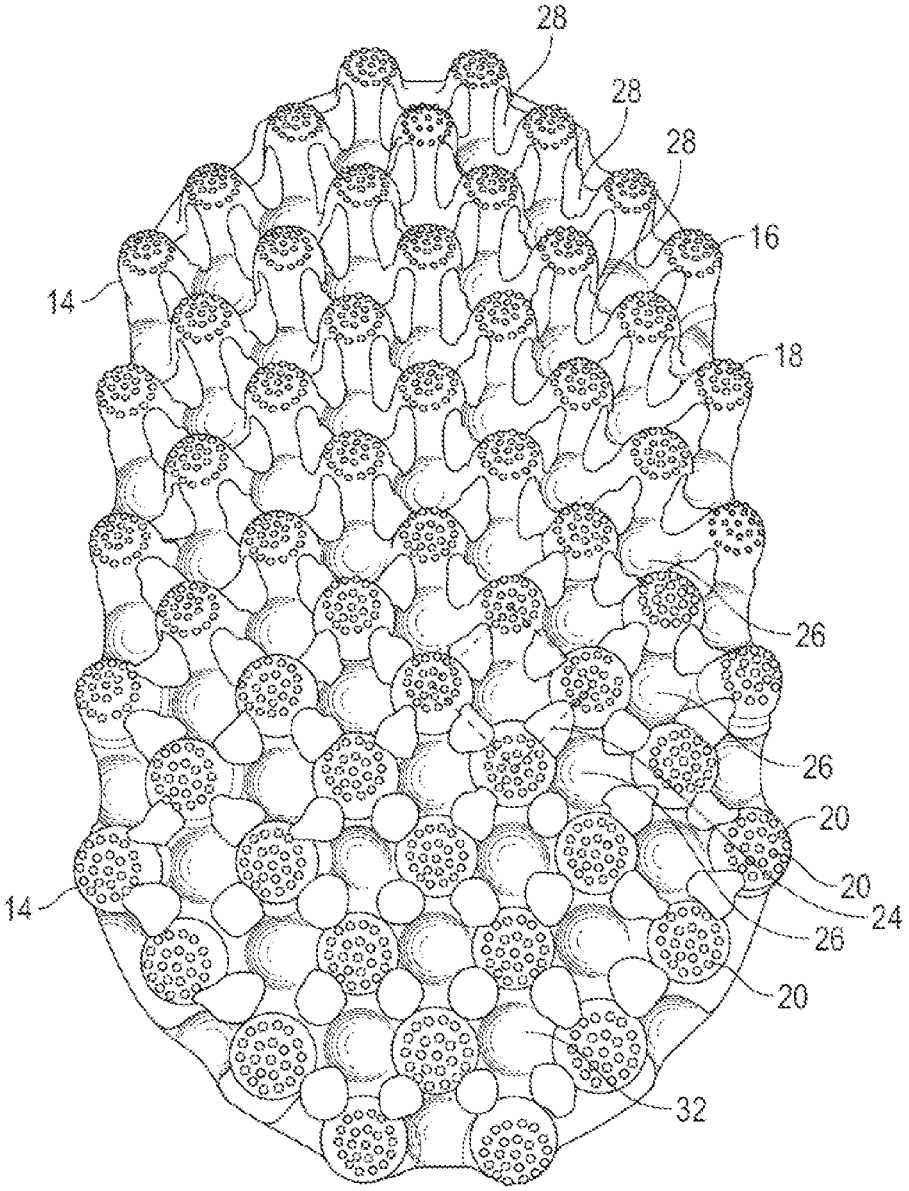
FIG. 3 is a front view of an apparatus for coiling hair in accordance with the features of the present invention.

Turning to FIG. 3, it shows a front view of the invented hair coiling device. As shown in FIG. 3, the working surface 14 of the device comprises a plurality of spaced-apart monoliths 16 having rounded distal ends 18. The monoliths 16 are positioned on the working end 14 of the hair coiling device so that the monoliths' centers are positioned at the vertices of squares 24 or rectangles having sides of substantially similar lengths. The representative square 24 is shown in the figure in dashed lines. In most embodiments, the squares are not directly imprinted on the working surface 14 of the device, but is depicted in the figure to aid in understanding of the arrangement of the features on the working end 14 of the hair coiling device. In an exemplary embodiment, the monoliths 16 have a diameter that is preferably between approximately 10 mm and approximately 15 mm, more preferably between approximately 10 mm and approximately 12 mm, and most preferably between approximately 10 mm and approximately 11 mm. In an exemplary embodiment, the monoliths have a diameter of approximately 10 mm.

As mentioned, supra, the distal ends 18 of the monoliths feature small, round gripping projections 20. FIG. 3 shows exemplary positions of the gripping projections. As shown in FIG. 3, a gripping projection is positioned in the center of the distal end of the monolith and surrounded by spaced apart, coaxial rings of gripping projections. This configuration is exemplary and not meant to be limiting. The gripping projections can be positioned anywhere in any number on the distal end of the monoliths in a regular pattern, a semi-random pattern, or pursuant to a random distribution.

FIG. 3 and other figures thereafter show the gripping projections 20 as round in shape. This depiction is exemplary and not meant to be limiting. The gripping projections can be any shape. Further, a single embodiment of the invented hair coiling device can feature gripping projections of multiple shapes and sizes.

The gripping projections are a salient feature of the instant invention. When the invented apparatus is in use, the gripping projections increase frictional engagement between the monoliths and hair. This increased frictional engagement assists in pushing or directing the hair to be coiled into nearby apertures.

Each monolith in the embodiment of FIG. 3 is surrounded by a series of alternating semi-spherical dimples 26 and apertures 28. The dimples 26 and apertures 28 are positioned surrounding the monolith such that each dimple is positioned between two apertures, and each aperture positioned between two dimples. The dimples are positioned such that they are disposed at the vertices of squares with a monolith in the center. Similarly, the apertures are positioned at the squares' vertices, with each square featuring a monolith in the center.

Prior art devices frequently have apertures defined in a flat surface. In at least one embodiment, the device surface between the monoliths includes dimples, such as dimples 26 shown in FIG. 3. The dimples function as a reflector or redirector of the hair. When long or excess hairs that do not have contact with the monoliths 16 hit one of the dimples 26, the dimple will redirect the long or excess hairs to the apertures 28 or the monoliths 16.

A salient feature of the invention is its use as an apparatus for hair coiling. To accomplish this, a user places the working end of the invented device with its monoliths, dimples, and apertures against the hair and scalp of a person having their hair coiled. The working end is then dragged repeatedly over the hair being coiled using circular motions. The circular motions of the device cause portion of hair received by the apertures to form styled coils of hair. Increased friction and circular motions increase the tightness and number of styled coils.

In the FIG. 3 embodiment, the apertures are smaller in diameter than the dimples. This is exemplary and not meant to be limiting. In an alternative embodiment, the apertures are equal or nearly equal in size to the dimples. In yet another embodiment, the apertures, dimples, and monoliths feature the same or substantially similar diameters.

As shown in the figures, including FIG. 3, the apertures 28 are only on the surface of the working end 14. The apertures 28 do not extend through the entirety of the device. In one embodiment, the apertures are only a few millimeters in depth at a maximum point. The apertures 28 and the dimples 26 assist in directing the hair as it passes over the working end 14 of the device.

Figure 4:
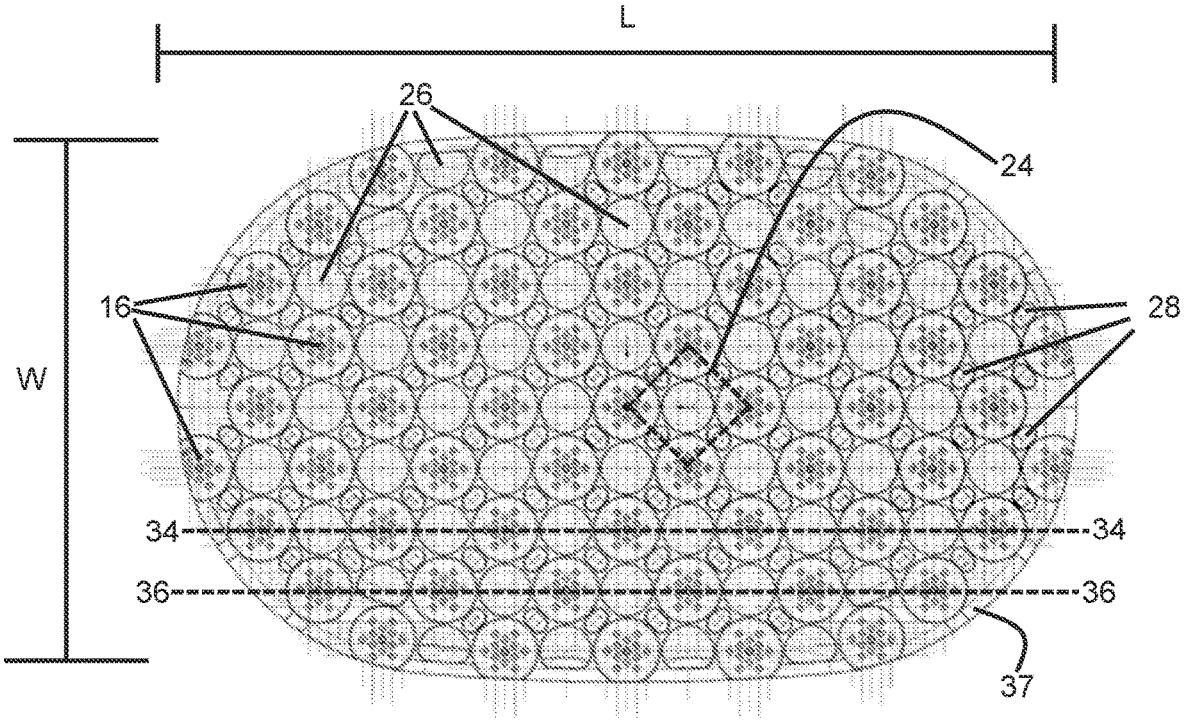
FIG. 4 is a cross-section of the working end of the invented apparatus for coiling hair in accordance with the features of the invention.

FIG. 4 is a detailed view of the working end of an embodiment of an invented hair coiling device. FIG. 4 depicts an ovular cross-section for the working end. This is exemplary and not meant to be limiting. The device generally, and the working end specifically can be any shape. The embodiment shown in FIG. 4 features nine rows 34, 36 of monoliths, each row featuring one more monolith than dimples. As shown in FIG. 4, the working end of the invented hair coiling device 10 comprises a periphery 37. In order to accommodate the maximum number of monoliths and dimples on the working end of the invented hair coiling device, said monoliths and dimples positioned near the periphery might feature a slightly flattened cross-section. As shown in FIG. 4, the working end of the invented device has a length L and width W. In an exemplary embodiment, L is approximately 147 mm, and W is approximately 90 mm. These dimensions result in a cross-section significantly smaller in area than prior art devices. As the instant invention features improvements such as the monoliths with gripping projections and dimples in the working end, the efficiency of coiling hair is improved in this device relative to prior art devices. These dimensions are exemplary and not meant to be limiting. The entire device, and specifically the working end, can be any size.

Returning to FIG. 2, the working end of the invented hair coiling device is engaged to the handle 22. FIG. 2 shows the handle as featuring a laterally facing surface that is curved to approximate the curvature of a user's hand. The lateral surfaces 38 of the handle feature ovular depressions 40. These depressions 40 are ergonomic features adapted to comfortably receive the fingers of a user when gripping the invented device. The configuration of the handle shown and described is exemplary and meant to be limiting. The handle can take any form sufficient to receive the working end of the device and allow for the device to be used according to the method described below.

Figure 5A:
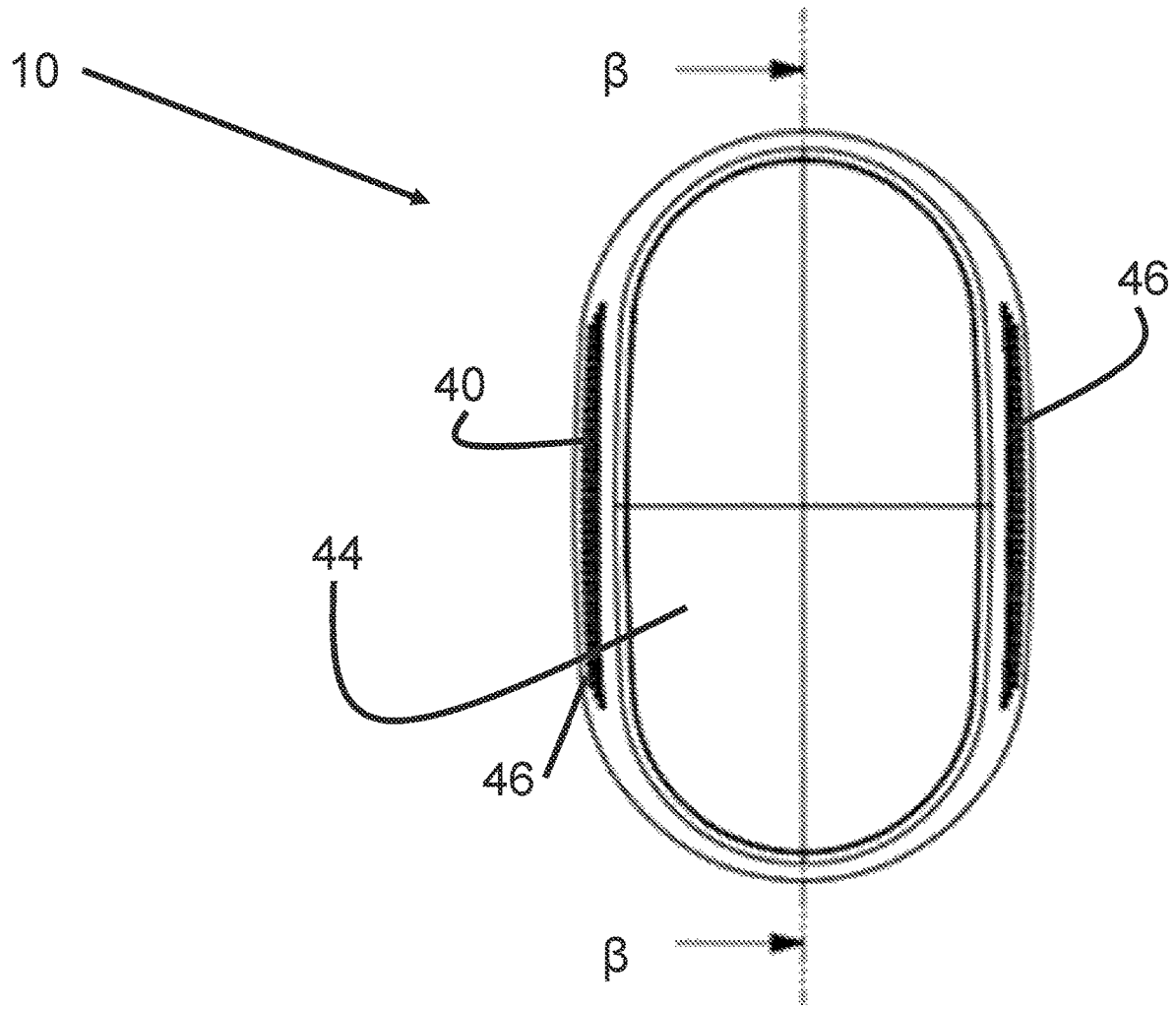
FIGS. 5A-D show various detailed views of an embodiment of the invention.

FIG. 5A depicts the details of the holding surface 44 of the device 10. As shown in FIG. 5A, the depressions 40 are located in the gripping areas 46 on side surfaces of the embodiment shown in FIG. 5A. The holding surface 44 shown in FIG. 5A is substantially flat.

A benefit of the embodiment shown in FIG. 5A is that the device is as small as possible given the reverse side of holding surface 44 is dedicated to the working area, and its monoliths shown in the remaining figures. The embodiment as shown in the figures, can be held comfortably by either left- or right-handed users and does not require a dedicated handle that could break off or otherwise take up space.

Figure 5B:
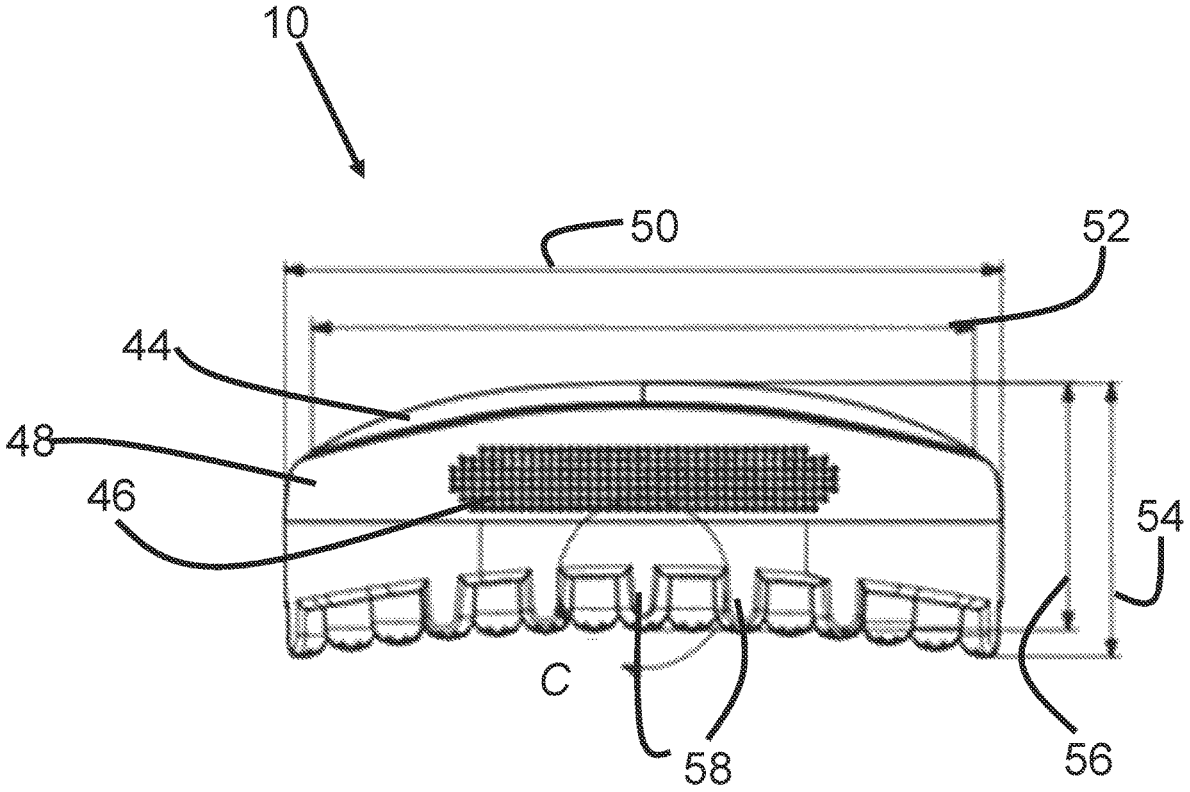

FIG. 5B is a side view of the device taken along the line 13 seen in FIG. 5A. FIG. 5B shows a side view of the embodiment of the device 10, including a detailed view of the gripping area 46. As shown in FIG. 5B, the gripping area 46 is located on an angled panel 48 of the holding surface 44. The angled panel 48 allows the holding surface 44 to better conform to the hand of an end-user. As shown in FIG. 5B, the device 10 has a series of protruding parts 58 along the outside of the device 10.

As shown in FIG. 5B, the total width 50 of the device 10 is approximately 147 mm. The inner width 52 is approximately 135 mm. The total height 54 of the device 10 is approximately 56 mm. The inner height 56 of the device 10 is approximately 51 mm.

Figure 5C:
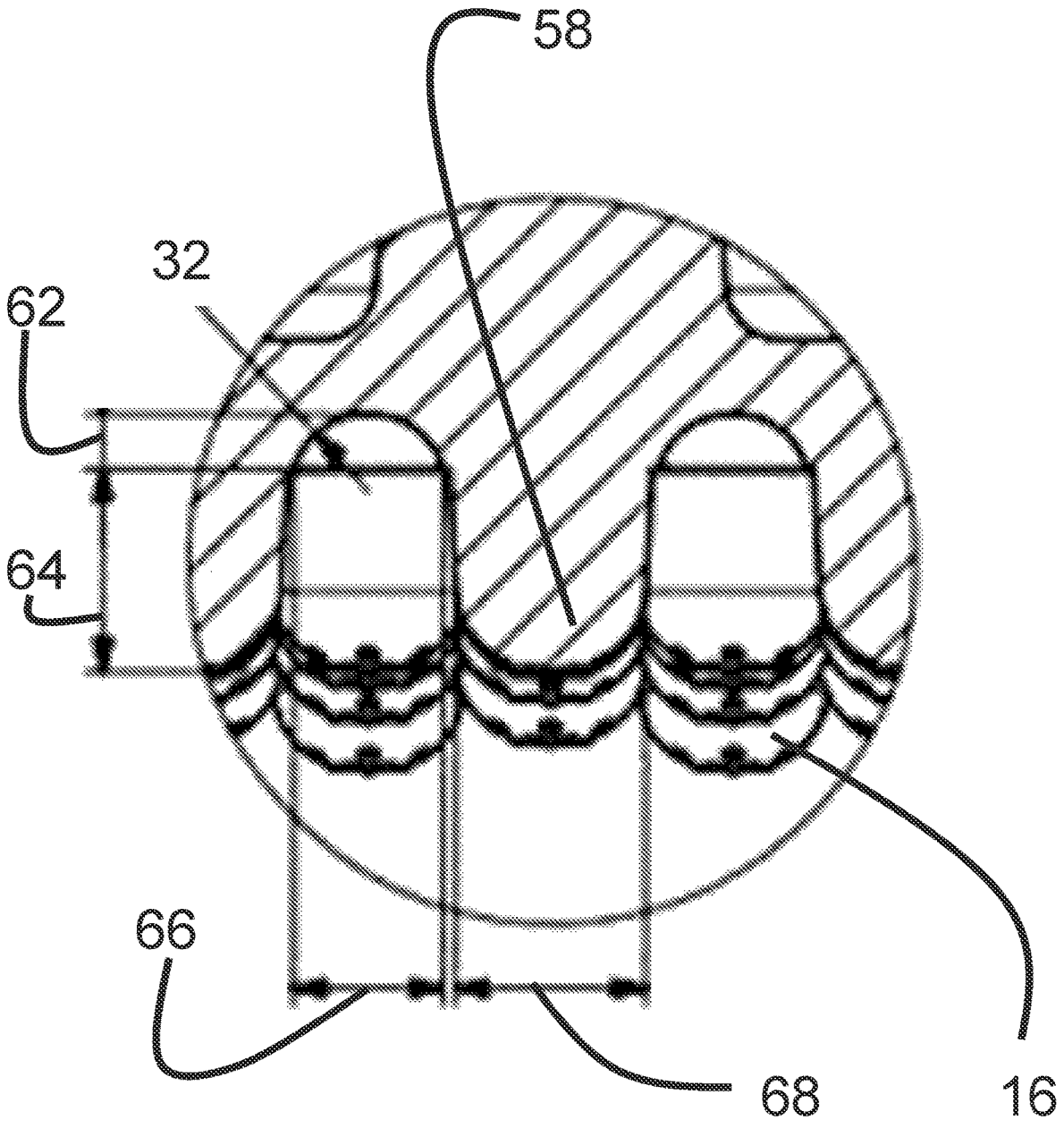

The area highlighted as "C" in FIG. 5B is shown as a detailed view of the monoliths 16, dimples 32, and other structures in the detailed side view of FIG. 5C. FIG. 5C shows the details of the protruding part 58 of the bottom and dimensions.

The interior measurement 62 of the dimple 32 is approximately 3 mm. The height 64 of the aperture is approximately 11 mm. The width 66 of the aperture is approximately 8 mm while the width 68 of the monoliths or the protruding part 58 is approximately 10 mm.

Figure 5D:
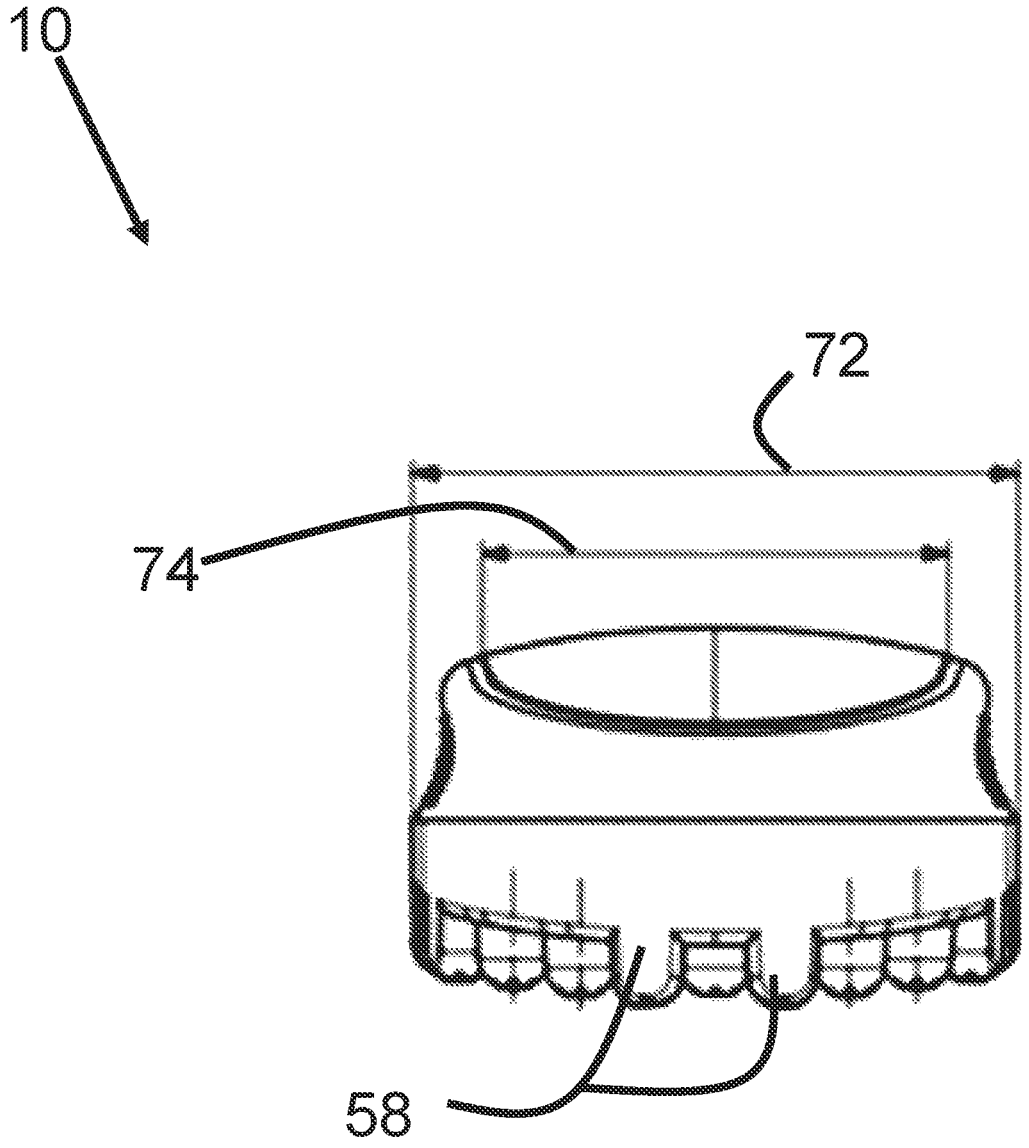

FIG. 5D shows a perspective view of the narrower side of device 10, showing two protruding parts 58 in the depicted of the device. In one embodiment, the device 10 is symmetric so that each shorter side is identical or similar to the view shown in FIG. 5D. Similarly, the longer sides shown in FIG. 5B are also mirror images of each other.

The outside width 72 of the device 10 shown is approximately 90 mm. The inside width 74 of the device 10 is approximately 70 mm in the depicted embodiment.

Figure 6:
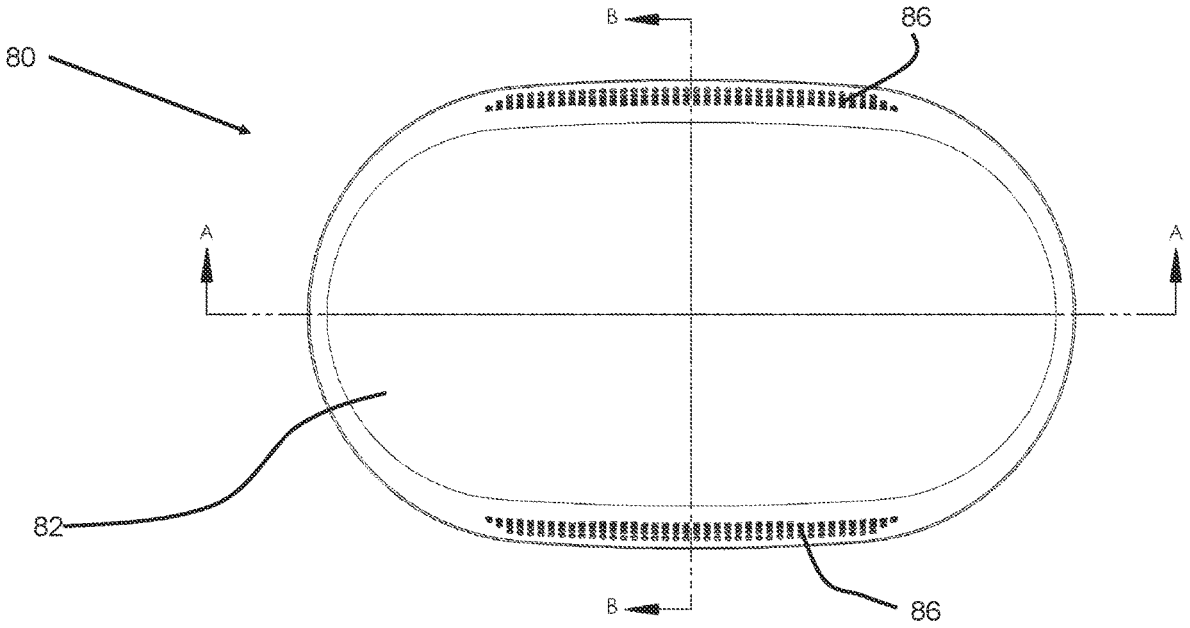
FIG. 6 is an overview of another embodiment of the invention.

Another view of an embodiment 80 is shown in FIG. 6. This embodiment includes a substantially oblong main body 82 with gripping areas 86 defined on each side of the main body 82. The gripping areas 86 are mirror-images of each other and have a pattern that follows the curvature of the main body 82. As the gripping areas are symmetric, the embodiment 80 can be used by either left-handed or right-handed end-users.

Figure 7A:
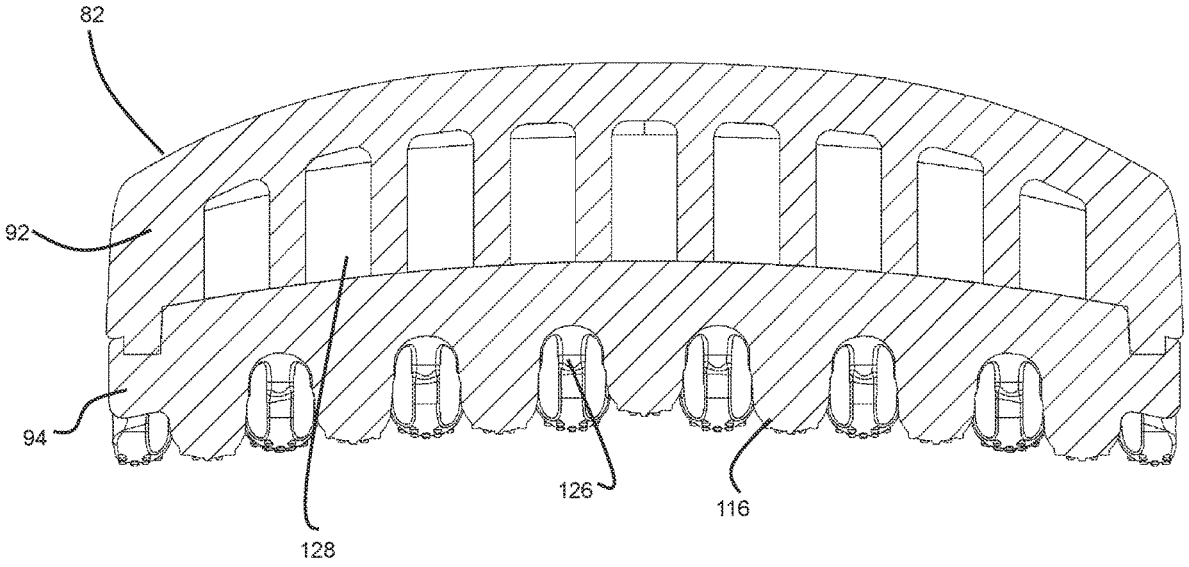
FIGS. 7A and 7B depict cross-sectional views of the embodiment of FIG. 6.

FIG. 7A is a side view taken along line A-A of FIG. 6. As can be appreciated in FIG. 7A, the main body 82 is divided into a first portion 92 and a second portion 94. In one embodiment, the first portion 92 and the second portion 94 form two subparts of the main body 82. The first portion 92 and the second portion 94 are frictionally engaged in one embodiment. In another embodiment, the first portion 92 and the second portion 94 are joined together using a repositionable adhesive, hook and loop fastener, and other possible removable methods. The removability of the second portion 94 allows for a variety of configurations of monoliths, dimples, and apertures, to be used, as described above. One configuration of the dimples 126, monoliths 116, and apertures 128 is visible in FIG. 7A.

As can be appreciated from the view in FIG. 7A, the apertures 128 in the depicted embodiment do not traverse the entirety of the first portion 92. This creates more stability in the first portion 92, especially as during use, the first portion 92 is held in an end user's hand. For this reason, the top view of FIG. 6 also shows a substantially flat top surface between the gripping areas 86. Hairstyling tools that have apertures spanning the entirety of the tool main body suffer from drawbacks such as contact between the user of the tool and the hair undergoing treatment. For example, in a salon setting, the end-user may be using such tools all throughout the day, and contact with treated hair is not desirable.

As shown in FIG. 7A, the removability of the second portion 94 also facilitates reuse of the tool even as the structures such as dimples and monoliths wear down with use. The second portion 94 can be replaced, even as the first portion 92 remains in use. In at least one embodiment, the first portion 92 comprises a softer material than the second portion 94, therefore making it easier to grip for extended periods of time. In another embodiment, the first portion 92 gripping areas 86, shown in FIG. 6, include a grip-enhancing material, such as a flowable gel enclosed in a small pouch or bladder, further enhancing the gripping ease of the final product.

As shown in FIG. 7A, the side profile of the main body 82 is substantially and arch, which makes the device particularly adapted for use on a person's head.

Figure 7B:
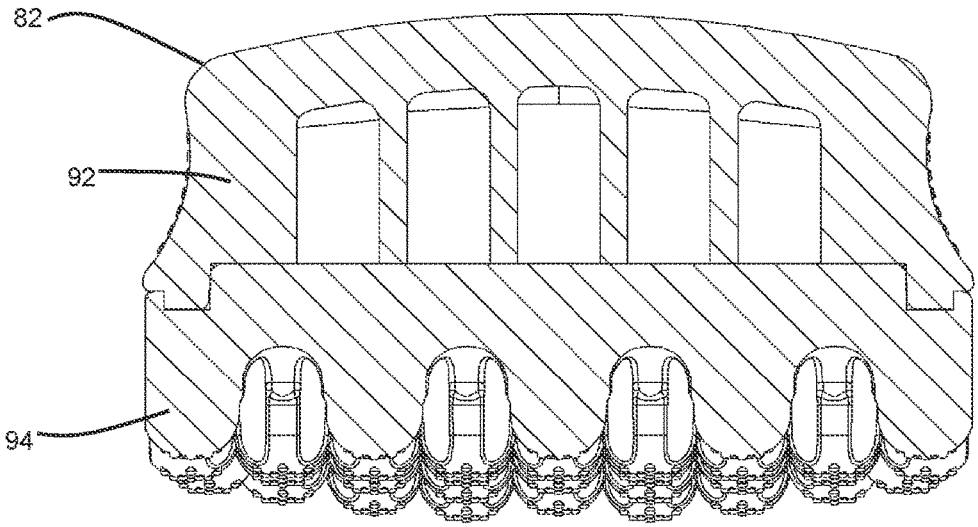

FIG. 7B is a second side view taken along line B-B of FIG. 6, showing the first portion 92 and the second portion 94.

Method of Use

To use the invented device, a user first grips the invented device by the sides of the body or by the non-working surface. The user then places the working end of the device into contact with the hair and head containing hair to be coiled. Once the device is in contact with the hair to be coiled, the user repeatedly moves the device in circular motions through and over the hair to be coiled. A user continues to move the device in circular motions through and over the hair to be coiled until the desired number and tightness of hair coils are achieved. The invented device and method can be used on dry, untreated hair. Alternatively, any desired hair products can be applied to hair to be coiled prior to the use of the invented device. In an alternative embodiment, a user applies product to hair once the device is already in use prior to completion of the desired hairstyle.

A benefit of this invention is that it allows for a variable amount of treatment of hair, which is dependent on the duration of contact between the hair and the device.

In use, the device does not require any powered elements. It does not include a motor, batteries, and any other active components. Instead, it can easily be operated by hand. The gripping features described above allow for comfortable use of the device both by retail customers and in a commercial haircare setting.

The device being made from a sufficiently rigid material can be used to provide a massaging action at the time of styling hair or applying a hair treatment.

Although exemplary implementations of the invention have been depicted and described in detail herein, it will be apparent to those skilled in the relevant art that various modifications, additions, substitutions, and the like can be made without departing from the spirit of the invention, and these are therefore considered to be within the scope of the invention as defined in the following claims.

It is to be understood that the above description is intended to be illustrative and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third" are used merely as labels and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

The embodiment of the invention in which an exclusive property or privilege is claimed is defined as follows:

1. An apparatus for coiling hair comprising:

a working end comprising a plurality of spaced-apart monoliths having round distal ends and a plurality of dimples surrounding at least one of the monoliths;

wherein said monoliths comprise a non-pliable material, wherein said monoliths are positioned at respective vertices of squares having sides of substantially similar lengths, wherein said dimples are semi-spherical and are positioned at respective centers of the squares, wherein centers of the plurality of dimples are located on a plane that defines a floor of the working end, and wherein the working end further comprises a plurality of apertures surrounding the at least one of the monoliths.

2. The apparatus of claim 1, wherein the round distal ends comprise a plurality of small round protrusions extending from the distal ends.

3. The apparatus of claim 1, wherein the at least one monolith is positioned inside a square formed by four apertures.

4. The apparatus of claim 3, wherein the plurality of dimples surround the at least one monolith so that the at least one monolith is positioned inside a square formed by four dimples.

5. The apparatus of claim 4, wherein the plurality of dimples and the plurality of apertures are alternatively positioned surrounding the at least one monolith such that each dimple is positioned between two apertures, and each aperture is positioned between two dimples.

6. The apparatus of claim 1, wherein the working end is concavely curved.

7. The apparatus of claim 1, wherein the monoliths are adapted to penetrate the hair of an end user down to the end user's scalp.

8. The apparatus of claim 1, further comprising a handle.

9. The apparatus of claim 1 wherein said monoliths comprise a cylindrical main body.

10. The apparatus of claim 1 wherein said apparatus comprises two subparts removably joined together.

11. The apparatus of claim 10, wherein a first subpart comprises a flat handle area and a second subpart contains the non-pliable monoliths.

12. The apparatus of claim 1 further comprising a gripping area defined in opposing sides of a main body of the apparatus.

13. The apparatus of claim 1, wherein the plane on which respective centers of the plurality of dimples are located is parallel to a longitudinal axis of the apparatus.

14. The apparatus of claim 1, wherein the plurality of apertures extend below the floor of the working end.

* * * * *